United States Patent [19]

Hermeyer et al.

[11] 4,177,406

[45] Dec. 4, 1979

[54] CIRCUIT FOR ADJUSTING TUBE ANODE CURRENT IN AN X-RAY GENERATOR

[75] Inventors: Bernd Hermeyer, Henstedt-Ulzburg; Rudolf Ochmann, Hamburg, both of Fed. Rep. of Germany

[73] Assignee: U.S. Philips Corporation, New York, N.Y.

[21] Appl. No.: 872,090

[22] Filed: Jan. 25, 1978

[30] Foreign Application Priority Data

Jan. 28, 1977 [DE] Fed. Rep. of Germany ..... 2703420

[51] Int. Cl.[2] ..... H05G 1/34

[52] U.S. Cl. ..... 315/307; 250/409; 315/106

[58] Field of Search ..... 315/106, 107, 307, 308; 250/409

[56] References Cited

U.S. PATENT DOCUMENTS

| | | | |
|---|---|---|---|
| 3,521,067 | 7/1970 | Splain | 250/409 X |
| 3,974,387 | 8/1976 | Bronner et al. | 250/409 |
| 4,072,865 | 2/1978 | Craig et al. | 315/307 X |

*Primary Examiner*—Eugene R. LaRoche
*Attorney, Agent, or Firm*—Thomas A. Briody; Edward J. Connors, Jr.; Jack E. Haken

[57] ABSTRACT

Filament current values associated with different X-ray tube anode currents and voltages are stored in various locations of a memory. For an X-ray exposure, the measured value of filament current or anode current is compared with the values stored and the values stored are connected, if necessary. Variations of the emission characteristics of the X-ray tubes as caused, for example, by aging are thus automatically corrected.

6 Claims, 3 Drawing Figures

CIRCUIT FOR ADJUSTING TUBE ANODE CURRENT IN AN X-RAY GENERATOR

Figure 1:
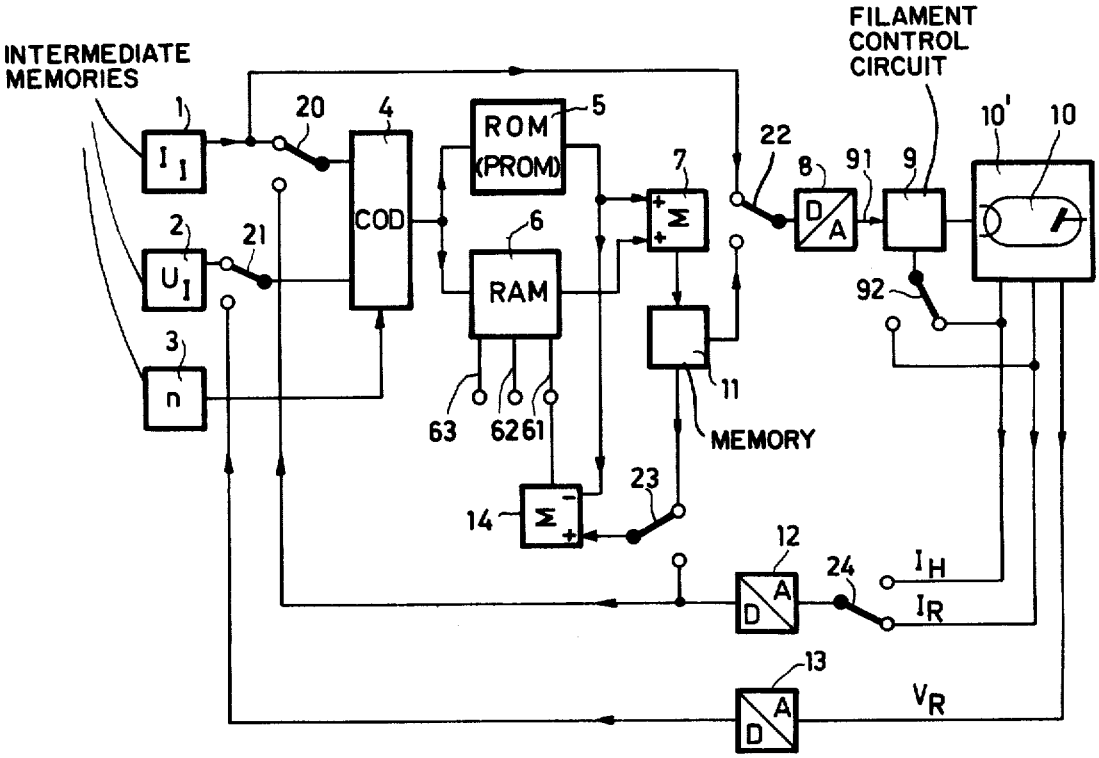

The invention relates to a circuit for adjusting X-ray tube anode current in an X-ray generator, comprising a coding device for forming an address from the preset values of anode current and anode voltage, an addressable memory device in which the filament current values associated with different anode currents and tube voltages are stored and wherefrom a filament current value stored at the address formed can be fetched, and furthermore comprising a filament current adjusting member which can be controlled in dependence of the filament current value fetched and which adjusts the filament current.

In known X-ray generators, the anode current required during an exposure is generally adjusted, prior to the start of the X-ray exposure so that when the high voltage is applied to the X-ray tube, the desired anode current is substantially emitted by the filament. The value of the filament current is not linearly dependent on the desired anode current and the tube voltage.

Therefore, the filament power supply circuit of prior art X-ray generators comprises adjusting means for the filament current which either serve only for adjusting anode current for a preset tube voltage or which follow a programmed, time-dependent function of the adjusting parameters which is produced by a function generator. Function generators of this kind are constructed so that they comprise either a few adjusting members, so that often only a coarse approximation of the actual anode current characteristics of the X-ray tube is possible, or a large number of adjusting members. In both cases, a number of adjusting members must be present for each type of X-ray tube and a large amount of adjusting by the service technician is required.

Deviations from the different preset values of anode current, selected by the adjusting parameters, must, however be accepted. These deviations are due, on the one hand, to the fact that it must be possible to operate the X-ray generator with different types of X-ray tubes with different emission behaviour; these deviations cannot be fully compensated with only a few adjusting means. Other deviations are due to the fact that tubes of the same type exhibit a different specific radiation behaviour. Moreover, the emission behaviour of X-ray tubes changes with age, so that in the course of time readjustment is necessary.

The circuit arrangement of the prior art has an advantage over known arrangements, for example, from U.S. Pat. No. 3,521,067, in that the anode current can be accurately preset in a simple manner. The memory device of this circuit arrangement is a read-only memory, preferably a programmable read-only memory, which is individually associated with an X-ray tube and in which the filament current values required for different voltages and anode currents of this X-ray tube are stored. The writing of the filament current values in the memories as a function of the anode current and tube voltage to be adjusted, can be realized by the tube manufacturer, during the required testing of the X-ray tube, during which this tube is tested with different combinations of tube current and tube voltage. However, when tubes are exchanged, merely the read only memory need be exchanged. Adjustment by the service technician is no longer required.

However, the described circuit arrangement still has some drawbacks: the emission behaviour of an X-ray tube which is liable to change due to aging is not taken into account. Organizational steps must be taken to avoid mixing up of read-only memories associated with different X-ray tubes. When use is made of X-ray tubes for which the manufacturer does not supply a read-only memory individually associated with the relevant tube, the writing of the filament current values into the read-only memory must be effected at the site of the user; it is then necessary to measure the emission behaviour of the X-ray for all anode voltage and tube current combinations for which a filament current value is to be determined and stored.

The invention has for its object to provide a circuit arrangement for adjusting the anode current in an X-ray generator which enables accurate presetting of the anode current in a simple manner.

To this end, a circuit arrangement in accordance with the invention further comprises a buffer memory for storing the fetched filament current value. The actual values of anode current and the actual tube voltage, measured during the exposure by means of a measuring device, are applied, instead of the preset values of anode current and tube voltage, to the input of the coding device which forms an address from these measured values. The filament current value stored in the buffer memory is then stored in a memory location of the memory device which is associated with that address.

A further circuit embodiment in accordance with the invention comprises a control circuit for the anode current which is activated after the beginning of an X-ray exposure and also comprises a measuring device for measuring at least the filament current. The filament current value is measured after termination of anode current control by the control circuit during the exposure and is stored at the address of the memory device which is formed by the coding device from the preset values of anode current and tube voltage.

In both embodiments the contents of the memory device are corrected during each exposure, in accordance with the values of anode current and tube voltage or of filament current measured during that exposure. In the first embodiment, when the filament current value fetched deviates from the correct value so that the preset values of anode current and tube voltage are not met, a new address is formed from the measured values of tube current and tube voltage, the original filament current value being stored at this new address. In the second embodiment, when the filament current value stored deviates from the correct filament current value, the correct (new) filament current value produced by anode current control is stored at the original address in the memory device.

Because the filament current values stored are corrected during X-ray exposures, the correct filament current values need not be present from the beginning in the memory device. Furthermore, as a result of this continuous correction of the filament current values, the changed emission behaviour of the X-ray tube due to aging is also taken into account.

The two solutions can also be combined which offers the advantage that two filament current values are corrected for one exposure. In that case, the values of anode current and voltage are measured, after the beginning of the exposure for the filament current adjusted prior to the exposure and the values being applied to the relevant inputs of the coding device. The coding device supplies a new address if the filament current value deviates from the correct value. The original filament current value fetched prior to the beginning of the exposure is stored at the new address. Subsequently, the filament current adjusting member is switched over for anode current control. When the preset values of anode current and tube voltage are attained, the filament current value is the correct filament current value required for the preset voltage; it is stored at the original address of the memory device. The original address is formed by connecting the input of the coding device to a reading device. Alternately, the measured values of tube voltage and anode current, corresponding to the preset values at the end of anode current control, can be applied to the input of the coding device.

A preferred embodiment of the invention is characterized in that the memory device further comprises a read-only memory in which the characteristic filament current values associated with the preset values of anode current and voltage are stored at memory locations bearing the addresses formed by the coding device. The circuit also comprises a random access memory for storing correction values and a summing device for summing the values stored at the address formed by the coding device in the read-only memory and the random access memory. A subtraction device subtracts the contents of the addresssed memory location in the read-only memory from the filament current value and writes a correction value thus obtained at the random access memory address formed by the coding device. The filament current values stored can then be the same for all X-ray tubes of a given type and identically programmed read-only memories can be used for all X-ray tubes of the same type. The filament current values stored correspond to a characteristic specimen. During operation of an X-ray tube, the deviations from the filament current values stored in the read-only memory are stored in the random access memory. The filament current value appearing on the output of the summing device thus consists of a characteristic value stored in the read-only memory and a deviation from the characteristic value associated with the relevant tube.

Because the difference between the value stored at the corresponding address in the read-only memory and the actual filament current value occurring in the filament circuit is stored each time in the random access memory by means of the subtraction circuit, the sum of the values stored at the two addresses corresponds to the new filament current value adapted to the tube. As a result of the use of a read-only memory, when the contents of the random access memory are erased, for example by interference signals, the values characteristic of the X-ray tube type are still present in the read-only memory. Moreover, when a new X-ray tube is put into operation, a basic adjustment is present. The magnitude of the correction values stored in the random access memory can be limited, so that a change of the correction values caused, for example, by interference signals cannot cause undesirably large deviations of the characteristic value, which could damage the tube in given circumstances.

Figure 2:
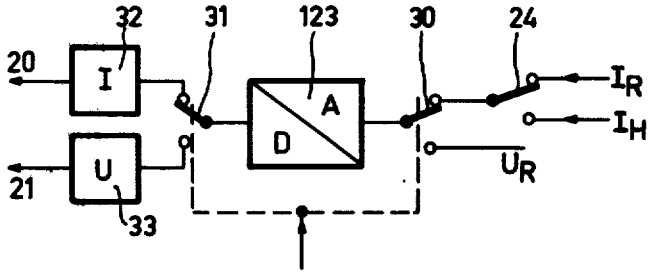
Figure 3:
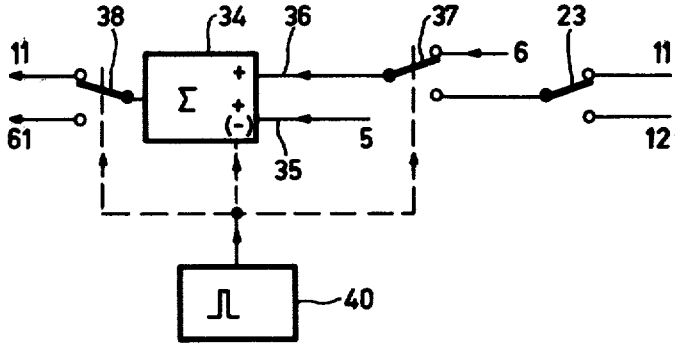

One embodiment in accordance with the invention will be described in detail hereinafter with reference to the accompanying diagrammatic drawing in which FIG. 1 shows a circuit in accordance with the invention, FIG. 2 shows an embodiment of a device for converting the analog measuring values of anode current and tube voltage into digital signals, FIG. 3 shows an arithmetic unit which performs the functions of the summing device and the subtraction device.

In FIG. 1 the preset values of the tube voltage $U_I$ and the anode current $I_I$ and the tube number n (in the case of an X-ray generator whereto different X-ray tubes can be connected) are supplied in digital form from intermediate memories 1, 2 and 3, respectively, via switches 20, 21, to a coding device 4 which forms an address on the basis thereof. This address determines a memory location in a memory device which preferably consists of a programmable read-only memory 5 and a random access memory 6, the address inputs of which are connected to the output of the coding device 4. The read-only memory 5 stores the emission characteristics of the n different X-ray tubes (generally n is smaller than or equal to 3), so that the memory location bearing the address formed by the coding device stores the filament current value associated with the preset values of anode current and tube voltage applied to the input of the coding device. The filament current value is a value characteristic of the selected tube type. However, the characteristics of X-ray tubes of one and the same type differ slightly with respect to each other. The deviation of the filament current from the value characteristic of the X-ray tube used is stored as a correction value at a corresponding address of the random access memory 6. An adding circuit 7, connected to the outputs of read-only memory 5 and the random access memory 6 adds the characteristic value and the correction value. The correction value may be negative. The sum of the two values is stored in a memory 11 during an X-ray exposure and is applied, via a switch 22 and a digital-to-analog converter 8, to the preset value input of a control circuit 9 which determines the filament current for an X-ray tube 10. The X-ray tube 10 is included in a measuring device 10' for determining the value $I_H$, $I_R$ and $U_R$ which are measures of the filament current, the anode current and the tube voltage, respectively.

During "preparation," i.e. prior to the start of an X-ray exposure, the filament current value is applied to the preset value input 91 of the filament current circuit in the described manner. When an exposure is made, a high voltage $U_R$ is applied to the X-ray tube in the customary manner and an anode current $I_R$ is conducted. At the same time, the switches 20 and 21 are switched over. The analog signal $I_R$ is applied, via an analog-to-digital converter 24 and the switch 20, to the "current" input of the coding device 4. The anode current $I_R$ measured equals the preset value of the anode current $I_I$ only if the fetched filament current value corresponds to the filament current value required for this anode current/voltage combination. In all other cases there will be a deviation which may also affect the tube voltage if there is no tube voltage control to maintain the voltage independently of the anode current. The tube voltage is also measured in order to enable such changes in the tube voltage to be taken into account the tube voltage is also measured (in a manner not shown) and the analog measuring value $U_R$ is applied, via an analog-to-digital converter 13 and the switch 21, to the "voltage" input of the coding device 4. The time required for the switching of the preferably electronic or fast electromagnetic switches 20 and 21 and for the analog-to-digital conversion is generally small in comparison with the exposure duration.

After completion of an analog-to-digital conversion, memory locations in the memory devices 5 and 6 are addressed via the coding device 4. Said location corresponding to the actual value $U_R$ and $I_R$ of anode voltage and tube current, respectively. An output of the memory 11 is connected to the plus input of a summing device 14. The minus input of device 14 is connected to the output of the read-only memory 5. The summing device 14 forms the difference between the actual filament current value prior to the start of the exposure, and a characteristic filament current value which is stored at the newly addressed address in the read only memory. The difference appears on the data input 61 of the random access memory 6 and is written into the random access memory 6 by a write signal on the write input 62, i.e., at the address (newly) formed by the coding device 4.

When the preset values $U_I$ and $I_I$ of voltage and anode current correspond to the measured, actual values $U_R$ and $I_R$, the same address of the memories 5 and 6 is available as during the "preparation" and the difference formed in the summing device 14 corresponds to the original contents of the random access memory 6. However, if the preset values and the actual values deviate, which occurs after the mounting of a new tube or due to aging of the tube, the deviation of the filament current value from the filament current value originating from the read-only memory 5 is written as a correction value in the random access memory 6 at the address which is determined by the measured, actual values $U_R$ and $I_R$ of voltage and tube current. The sum of the (new) correction value and the characteristic value stored at the corresponding address in the read-only memory 5 corresponds to the filament current value first fetched and stored in the memory 11.

If the actual values of voltage and anode current then measured is written in combination for a next exposure, the associated filament current will be correct and the desired tube current will occur. Due to the statistical variation of the exposure parameters during normal X-ray exposure operation, automatic control is thus obtained for a large part of the operating range of the tube. In the circuit of FIG. 1 described thus far, the filament current value which corresponds to the combination of the preset values $U_I$ and $I_I$ of voltage and anode current respectively and which is stored at the corresponding address in the memories 5 and 6 is not corrected, but rather the filament current value which is associated with the combination of the measured values $I_R$ and $U_R$ of anode current and voltage and which is stored at the corresponding address in the memories 5 and 6 is corrected.

However, it is alternatively possible to correct the filament current value associated with the preset values of voltage and anode current, This is effected as follows: by operation of the switch 22 and a switch 92 of the control circuit 9, the control circuit is switched over from "filament current control" to "anode current control." The construction of such a control circuit for either filament current control or tube control is separately described in the above mentioned U.S. Pat. No. 3,521,067.

After expiration of a period of time which exceeds the period of time required for adjusting the anode current, a switch 23, which switches the plus input of the summing device 14 between to the output of the memory 11 and the output of the analog-to-digital converter 12, is switched over and at the same instant a switch 24 is switched over, the latter switch then supplies the input of the analog-to-digital converter 12 with the measured actual value $I_H$ of the filament current instead of the actual value $I_R$ of the anode current measured by the measuring device 10'. At the same time, the address determined by the preset values $I_I$ and $U_I$ is again fetched.

This can be effected by returning the switches 20 and 21 to the position shown in FIG. 1 or by supplying the current and voltage inputs of the coding device 4 with the measured values $I_R$ and $U_R$ of anode current and tube voltage which must correspond to the preset values after termination of anode current control. The summing device 14 then forms the difference between the actual value $I_H$ of the filament current, present on the output of the analog-to-digital converter 12, and the characteristic filament current value stored in the read-only memory 5 at the address determined by the preset values $U_I$ and $I_I$ of anode voltage and anode current. After a write signal has been applied to the input 62, this difference is stored at this address in the random access memory 6 which is a non-destructive memory in order to prevent the loss of data stored therein after the switching-off of the installation.

When an X-ray tube is replaced, the contents of the random access memory 6 are erased via the reset input 63. The writing of the correction values adapted for the new X-ray tube can be realized by the successive input of the various feasible combination of anode current and voltage. The correction values are then automatically determined without manual adjustment.

When an X-ray tube is replaced by an X-ray tube of a different type, it is in principle not necessary to also replace the read-only memory 5. However, in that case larger correction values must be accepted.

It is alternatively possible to fill the read only memory with the characteristic values of only one tube type and to use this read-only memory for operation with more than one tube, as long as these tubes are of the same type. In that case, each X-ray tube requires a random access memory having the same storage capacity as the read-only memory, one memory being selected each time via the intermediate memory 3. In this case, however, use can alternatively be made of a single random access memory having a correspondingly larger capacity. The part of the random access memory associated with a given type of tube is then selected via the intermediate memory 3.

The analog-to-digital converters 12 and 13 for converting the analog measuring values $I_R$ and $U_R$ can be replaced, as shown in FIG. 2, by a single analog-to-digital converter 123, if the analog input signals are applied thereto in a time-sequential manner. To this end, the input of the analog-to-digital converter 123 is connected, via a switch 30 which can be switched over during the exposure, to the lead carrying the analog value of the voltage or to the switch 24, via which the actual value of the anode current (and at a later instant the actual value of the filament current) is supplied. The output of the digital-to-analog converter can be connected, via a switch 31 which is operated in synchronism with the switch 30, to two registers 32 and 33 which buffer the digital actual value of anode current and voltage, respectively.

The subtraction circuit 14 and the summing device 7 can be replaced, as shown in FIG. 3, by an arithmetic unit 34, one input 35 of which can be switched over for addition or subtraction and which is connected to the output of the read-only memory 5, the other input 36 thereof being connected, via a switch 37, to either the output of the random access memory 6 or to the switch 23 via which the filament current value is supplied in digital form. The output of the arithmetic unit 34 is connected, via a switch 38, either to the input of the buffer memory 11 or to the input 61 of the random access memory 6. The switching over from addition to subtraction and the switching of the switches 37 and 38 from the one position to the other position is effected in synchronism at the beginning of an X-ray exposure.

The control circuit which determines the timing of the processes described with reference to the FIGS. 1 to 3 (for example, the switching over of the switches 20 to 24, 30 and 31 and also 37 and 38; the storage of data in the memories 11 and 6, etc.), comprises a pulse generator 40, the operation of which is syncronized with the completion of an X-ray exposure. Its construction will be known to those skilled in the art who are familiar with the described process. The control circuit may alternatively be an arithmetic unit in the form of a microcomputer or a microprocessor. This arithmetic unit then provides the coding the addressing of the memory device 5, 6, the addition of the values and the intermediate storage thereof during the preparation phase and, after the beginning of the exposure, it ensures that, on the basis of the output values of the analog-to-digital converter, renewed coding is performed, and also subtraction of the characteristic filament current value stored in the read-only memory 5 from the stored, first fetched filament current value, and also the writing in the random access memory of the result of the subtraction. Finally, the address determined by the preset values of anode current and voltage is again adjusted and the characteristic filament current value from the memory 5 is subtracted from the value $I_H$ of the actually measured filament current. It will be obvious that the coding device, the subtraction device, the summing device, all switches and memories (1, 2, 3, 11, 32 and 33) can be replaced by a microcomputer or microprocessor.

Depending on the storage capacity of the memories used, only the filament current values for given combinations of anode current and voltage can be stored. However, the filament current values for other combinations can also be determined, for example, by linear interpolation between different filament current values. In that case, the intermediate memories 1, 2, 3 must supply different addresses and the values stored thereat must be read. The exposure voltage to be adjusted may then lie between two preset values for which the value of the filament current is stored in the memories 5 and 6. The two memory locations in which the adjoining preset values are stored (in combination with the desired exposure current) must be read and applied to an interpolation device (not shown) which performs a linear interpolation between the preset values (this interpolation can be readily performed by the said microcomputer or microprocessor). In the above case, the correction value may not be written at a single address, but must be assigned to both addresses used for the interpolation, the assignment of the correction value involving the use of a weighting factor used for the interpolation for determining the filament current value.

What is claimed is:

1. In a circuit for adjusting anode current in an X-ray generator of the type which includes coding means which function to form an address from values of anode current and tube voltage; addressable memory means which function to store filament current values associated with different combinations of anode current and tube voltages and to select and fetch these values in response to addresses formed by the coding means; and filament current adjusting means connected to receive the filament current values fetched from the memory means, which function to adjust a filament current in response to the values fetched; the improvement wherein:

the circuit further comprises a buffer memory connected to store the filament current value fetched from the memory means;

measuring means which function to measure the actual values of anode current and tube voltage during an X-ray exposure and which apply said measured values of anode current and tube voltage to the input of the coding means, whereby an address is formed from these measured values; and means which function to store a filament current value from the buffer memory at a memory location in the memory means which is associated with the address formed from the measured values of anode current and tube voltage.

2. In a circuit for adjusting anode current in an X-ray generator of the type which includes coding means which function to form an address from preset values of anode current and tube voltage; addressable memory means which function to store filament current values associated with different combinations of anode currents and tube voltages and to select and fetch a filament current value stored at the address formed by the coding means; filament current adjusting means which, at the beginning of an X-ray exposure, receive the filament current value fetched and adjust the tube filament current to said fetched value; and feedback means which are activated during the X-ray exposure and which then function to deactivate the filament current adjusting means and to control tube filament current in response to the difference between the preset anode current value and the actual anode current; the improvement comprising:

means which function to measure the actual value of filament current produced, during an exposure, by said feedback means and to store said measured value at an address in the memory means which is formed by the coding means from the preset values of anode current and tube voltage.

3. A circuit as claimed in claim 1 or 2 wherein the addressable memory means comprise:

a read-only memory in which characteristic filament current values, each of which is associated with a combination of preset anode current values and tube voltage values, are stored;

a random access memory connected to store correction values;

summing means connected to form the sum of a value stored in the read-only-memory with a value stored at a corresponding address in the random access memory;

subtracting means connected to subtract the contents of an address location in read-only-memory from the filament current value to produce a correction value; and writing means which function to write the correction values thus obtained in the corresponding address of the random access memory.

4. A circuit as claimed in claim 3 wherein the random access memory further comprises a reset input which enables erasing of the memory when a tube is replaced.

5. A circuit as claimed in claim 3 comprising arithmetic means (34) which include the summing means and the subtraction means; a first input (35) of the arithmetic means being switchably connected, for summing or subtraction, to the output of the read-only-memory, a second input of the arithmetic means (36) being switchably connected between the random access memory (6) and the means for measuring the filament current (12).

6. A circuit as claimed in claim 1 or 2 further comprising analog-to-digital converter means which function to convert measured analog values of tube voltage, anode current, and filament current into digital values, wherein the analog-to-digital converter means function to sequentially interrogate said measured analog values and to store digital values of the tube voltage in a voltage value register and digital values of the currents in a current value register.

* * * * *